United States Patent [19]

Fox

[11] Patent Number: 4,926,965

[45] Date of Patent: May 22, 1990

[54] SELF-RETRACTING STEP

[76] Inventor: Mark Fox, 532-210th SW., Lynnwood, Wash. 98036

[21] Appl. No.: 423,344

[22] Filed: Oct. 18, 1989

[51] Int. Cl.[5] ..... B63B 27/14; B63B 27/00

[52] U.S. Cl. ..... 182/89; 182/91; 114/362

[58] Field of Search ..... 182/91, 92, 90, 89; 114/362

[56] References Cited

U.S. PATENT DOCUMENTS

| | | | |
|---|---|---|---|
| 326,098 | 9/1885 | Bodman | 182/91 |
| 814,687 | 3/1906 | Gault | 182/89 |
| 2,678,832 | 5/1954 | Wright | 182/91 |
| 3,195,680 | 7/1965 | Thornburg | 182/92 |
| 3,794,140 | 2/1974 | Sell | 114/362 |
| 4,541,661 | 9/1985 | Hawk | 182/91 |
| 4,733,752 | 3/1988 | Sklar | 182/91 |
| 4,742,795 | 5/1988 | De Prey | 182/91 |

*Primary Examiner*—Reinaldo P. Machado

*Attorney, Agent, or Firm*—Christensen, O'Connor, Johnson & Kindness

[57] ABSTRACT

A self retracting step apparatus (10) mounted on the underside of a boat step (12) that projects rearwardly from the transom (14) of a boat. The step apparatus includes a mounting bracket (26) to which a support bar (16) is pivotally connected. A stirrup step (20) is secured to the distal end of the support bar, and is pivotal between an extended position and a retracted position. The support bar and stirrup step define a forwardly facing reactive surface (24) against which drag forces act upon movement of the boat. Springs (22) connected from the mounting bracket to the support bar nominally bias the stirrup step to the extended position, but may be overcome by the drag forces to allow the stirrup step to begin pivoting towards the retracted position. Once the stirrup step has begun movement from the extended position, the springs act to compel further pivoting of the stirrup step to a retracted position for stowage.

20 Claims, 4 Drawing Sheets

Fig. 1.
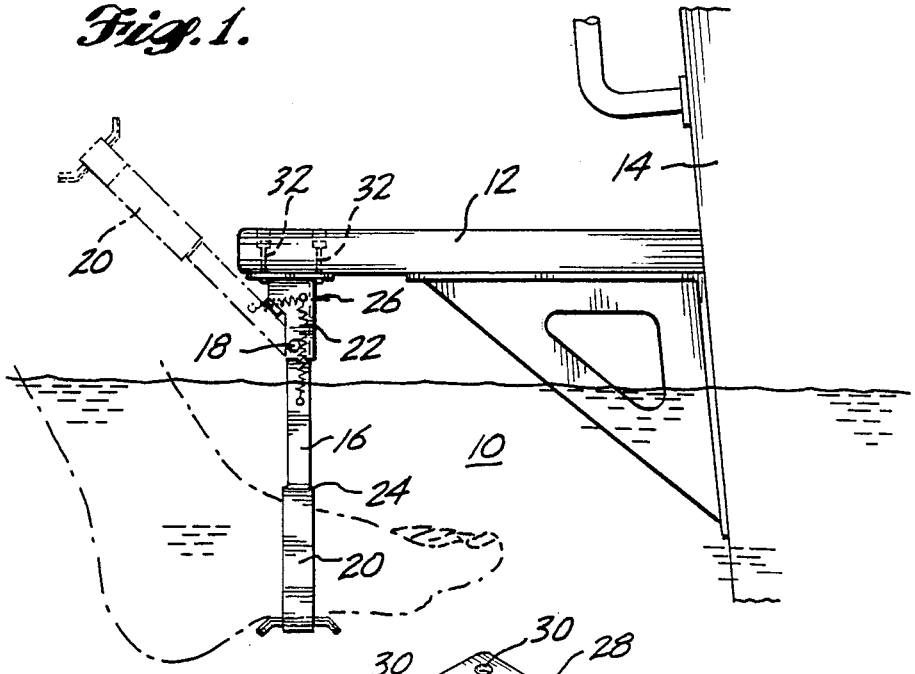
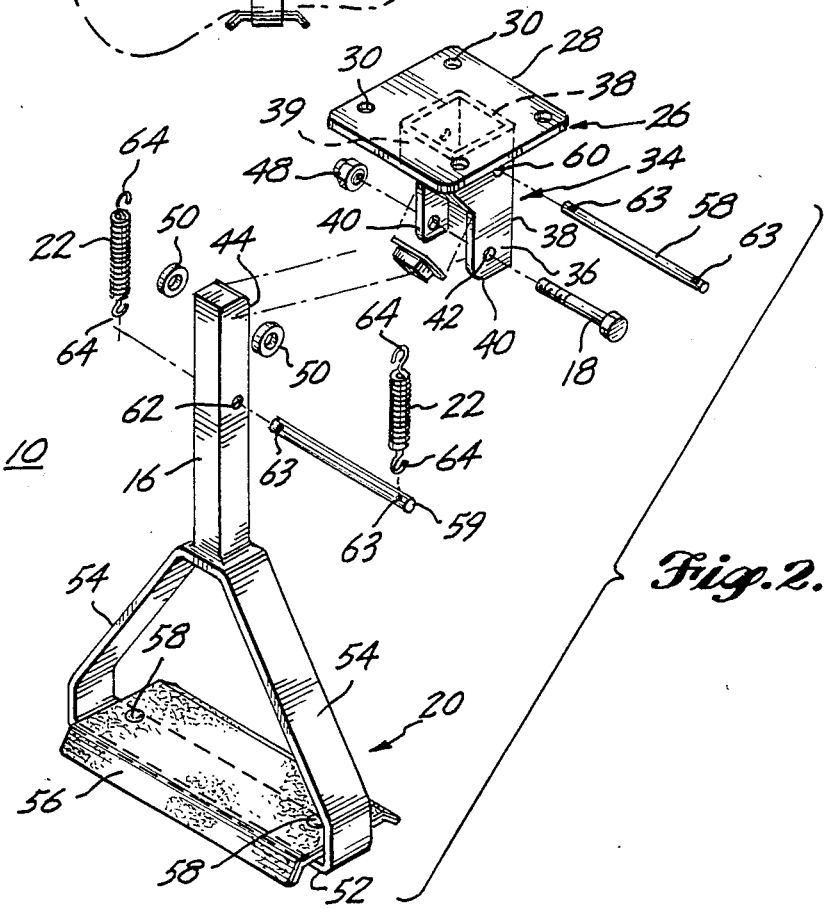
Fig. 2.

Fig. 7.
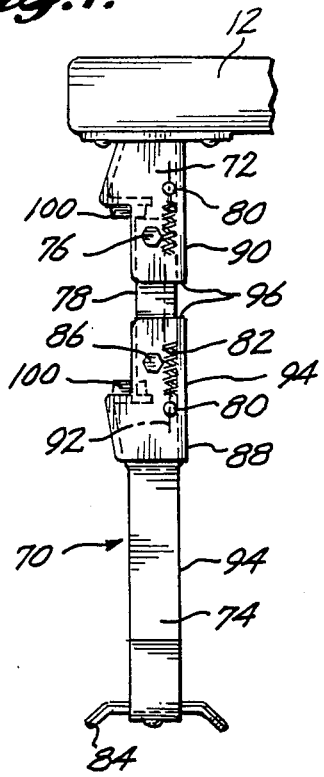
Fig. 8.
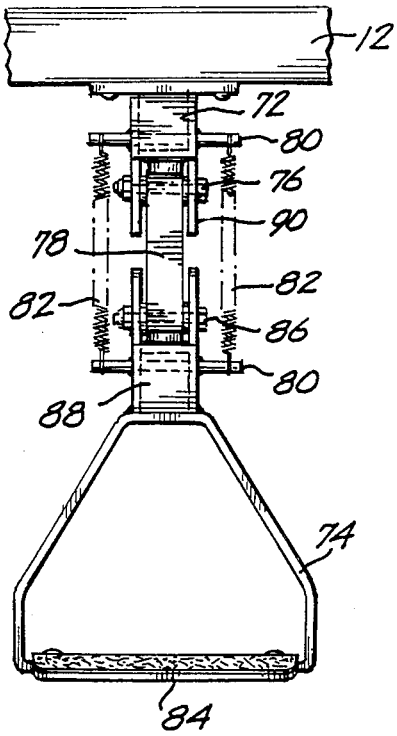
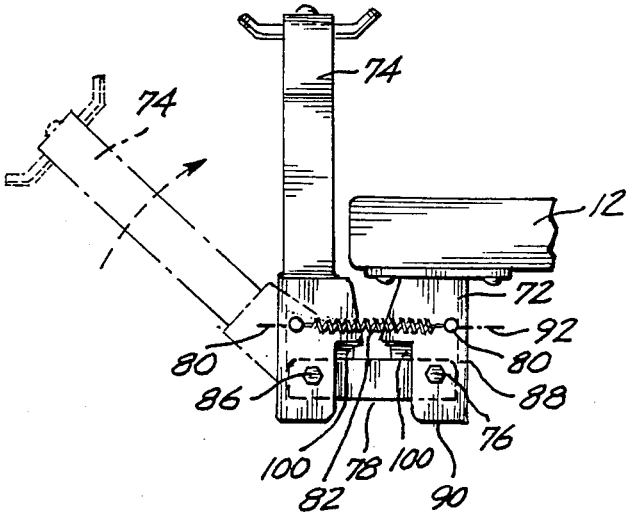
Fig. 9.

SELF-RETRACTING STEP

BACKGROUND OF THE INVENTION

The present invention relates to an apparatus for pivotally mounting a device to the exterior of a vehicle, and more particularly to an apparatus for pivotally mounting a device to the hull of a boat and, even more particularly to a self-retracting step apparatus pivotally mountable to a boat hull.

It is often necessary to mount devices such as steps, mirrors, antennas, and transducers in an outwardly projecting disposition from the exterior of vehicles, including watercraft, automobiles, trucks, and recreational vehicles. Unfortunately, these devices can generate significant drag resistance forces during movement of the vehicle, reducing the vehicle speed and fuel efficiency, and also may be struck and broken by obstacles passed by the vehicle during movement. Various methods for hingedly mounting devices to vehicles have been developed in the past to allow devices to be folded inwardly against the vehicle in an attempt to reduce drag resistance and the chance of breakage.

For example, several methods have been previously developed for hingedly mounting steps or ladders to the hull of boats to assist water-skiers and swimmers in climbing from the water into the boat. Conventional hinged steps that may be swung between a downward position, in which the step projects into the water for use, and an upward position, wherein the step is folded to overlie a transom mounted platform swim step, have been disclosed by U.S. Pat. No. 3,195,680 to Thornburg et al. and U.S. Pat. No. 3,794,140 to Sell. However, these conventional folding steps are limited in that they must be manually rotated from the downward to the upward position after use. Should the user neglect to upwardly fold the step after use, the step remains in the water, bouncing and swinging with movement of the boat and generating substantial drag resistance.

Another conventional example involves the mounting of a ladder-type boat step utilizing a scissors mounting apparatus that may be upwardly collapsed underneath a platform swim step after use and retained there by engaging a clamp or strap, as disclosed by U.S. Pat. No. 4,733,752 to Sklar. Again, this conventional manner of step mounting is limited in that the user must affirmatively fold the ladder to its upward position and engage a restraining mechanism to prevent the ladder from remaining in the water after use and creating drag resistance during movement of the boat.

Other conventional apparatuses have been developed for hingedly mounting large rear view mirrors to the outside of trucks and automobiles to allow the mirror to fold inwardly against the vehicle when the mirror is struck by an obstacle. However, inward folding of the mirror is driven by the force of impact with the obstacle, potentially resulting in damage to the mirror. After the mirror is inwardly folded due to impact, it typically is free to swing between its inwardly folded and outwardly extended positions, resulting in potential repeated impacts with subsequent roadside obstructions.

Conventional methods have also been developed for hingedly mounting steps to the undercarriage of motor vehicles that fold upwardly to collapse underneath the undercarriage when the motor vehicle passes over a roadside obstruction. Such a typical example is provided by the folding step disclosed by U.S. Pat. No. 2,678,832, issued to Wright. However, retraction of the step is again driven only by the force of impact with the obstruction, and the step tends to drop down due to its own weight after impact so that it may be struck repeatedly as the vehicle passes over subsequent obstructions.

SUMMARY OF THE INVENTION

The present invention discloses a mounting apparatus for pivotally mounting a device to the exterior of a vehicle. The apparatus comprises a support member to which the device is mounted, the support member and the device defining a reactive surface. A pivot joint mounts the support member to the exterior of the vehicle to allow the device to pivot between an extended position for use and a retracted position for stowage. The apparatus includes a spring that biases the device toward the extended position. The spring bias is capable of being overcome by a resistance force acting on the reactive surface during movement of the vehicle to shift the device from the extended position to the retracted position.

In a preferred embodiment, the proximal end of the support member is mounted by a pivot pin to a mounting bracket that is in turn mounted to the exterior of the vehicle. The spring has a proximal end that is pivotally secured to the mounting bracket in proximity to the vehicle and a distal end that is pivotally secured to the support member or the device. The spring is disposed generally perpendicularly to the central axis of the pivot pin and has a line of action that is offset slightly from the central axis of the pivot pin when the device is in the extended position. In this position, the spring biases the device toward the extended position. When a resistance force acts on the reactive surface defined by the support member and the device, the biasing force of the spring is overcome and the device is moved towards the retracted position. During initial movement of the device from the extended to the retracted position, the line of action of the spring starts to pass over the central axis of the pivot pin. When the line of action of the spring has passed over the central axis of the pivot pin, the spring then acts to bias the device towards the retracted position and retains the device there for stowage.

In an alternate embodiment, the apparatus further includes a second pivot pin that pivotally mounts the device to the distal end of the support member. When the apparatus is extended, the spring is perpendicular to the axes of the first and second pivot pins and has a line of action that is offset slightly from both axes, biasing the device toward the extended position. When the device is moved from the extended position by a resistance force acting on the reactive surface, the line of action of the spring passes over both central axes of the pivot pins and biases the device toward the retracted position.

The present invention provides a mounting apparatus that is biased to retain a device in the extended position for use while the vehicle on which it is mounted is stationary. It is not necessary after use to manually fold the device toward the retracted position. Rather, as the vehicle begins movement, the device will self-retract toward the retracted position as soon as a resistance force generated by drag or impact with an obstacle develops sufficiently to overcome the spring biasing force. As soon as the device is initially moved from the extended position, the bias spring acts to complete the movement of the device to its fully retracted position and retains the device safely stowed in that position until needed for further use.

BRIEF DESCRIPTION OF THE DRAWINGS

The present invention will subsequently be described in greater detail, by way of example, with reference to the accompanying drawings in which:

FIG. 1 illustrates a side elevation view of a single-jointed step apparatus in the extended position mounted to the underside of a swim step projecting from a boat transom, with dashed lines showing positioning of the step apparatus in the retracted position;

FIG. 2 illustrates an exploded pictorial view of the single-jointed step apparatus of FIG. 1;

FIG. 7 illustrates a side elevation view of a double-jointed step apparatus in the extended position;

FIG. 8 illustrates a front elevation view of a double-jointed step apparatus in the extended position; and FIG. 9 illustrates a side elevation view of the double-jointed step apparatus in the retracted position with dashed lines showing movement of the step from the extended position.

Detailed Description of the Preferred Embodiments

Figure 3:
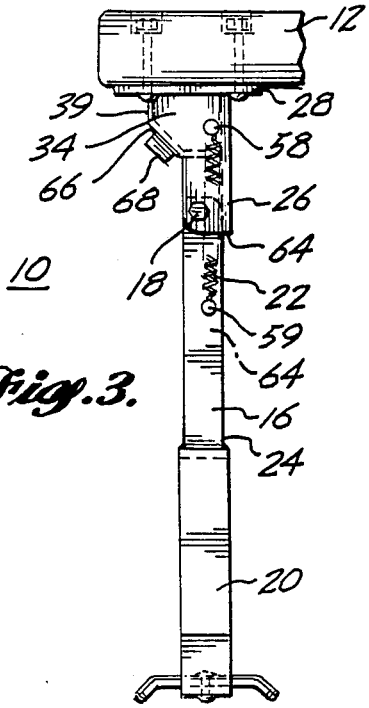
FIG. 3 illustrates a side elevation view of the single-jointed step apparatus in the extended position.
Figure 4:
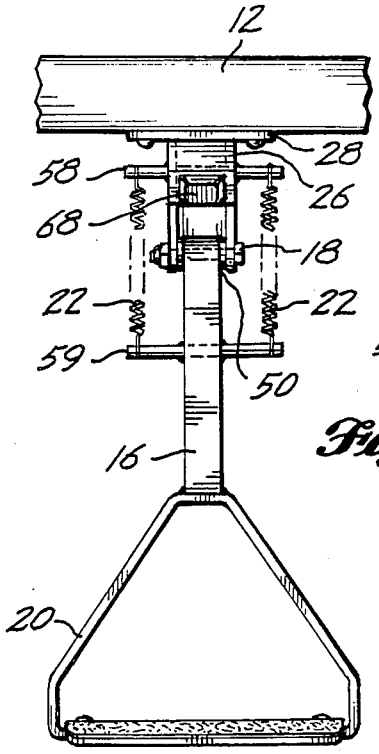
FIG. 4 illustrates a front elevation view of a single-jointed step apparatus in the extended position.

FIG. 1 illustrates a preferred embodiment of a step apparatus 10 constructed in accordance with the present invention and mounted to the underside of a platform-type swim step 12 that projects rearwardly from (away from ) the transom 14 of a boat. The step apparatus 10 includes a support bar 16 that is pivotally mounted to the swim step 12 by a first pivot pin 18. A stirrup step 20 is secured to the distal end of the support bar 16 and is biased to an extended position, as shown in FIG. 1, by two springs 22.

In FIG. 1, the step apparatus 10 is illustrated in the extended position, in which it is partially immersed in the water to a depth capable of receiving a person's foot to assist the person in climbing onto the swim step 12 and into the boat. Forward motion of the boat through the water while the stirrup step 20 is extended results in the creation of a water drag force acting on a reactive surface 24 defined by the transom (forward)-facing side of a portion of the support bar 16 and the stirrup step 20. The water drag force initiates the rotation of the stirrup step 20 towards a retracted position, as shown by dashed lines, in which the stirrup step 20 is withdrawn from the water and the water drag force is eliminated or at least reduced.

Details of the construction of the step apparatus 10 can be seen in the exploded view of FIG. 2. The apparatus 10 includes a mounting bracket 26 for pivotally mounting of the proximal end of the support bar 16 to the underside of the swim step 12. The bracket 26 has a flat plate portion 28 formed with a plurality of through-holes 30 to secure the bracket to the swim step 12 with bolts 32, as shown in FIG. 1. Other conventional means of mounting the bracket 26 to the swim step 12 may be utilized, such as riveting, welding or clamping.

Referring again to FIG. 2, the mounting bracket includes a collar 34 projecting downwardly from the underside of plate 28. The collar 34 may be formed from a length of hollow square-cross-sectioned tubing, or cut and formed from sheet stock, as illustrated. The bracket collar 34 has a forward wall 38 closest in proximity to the boat transom 14, side walls 40 projecting rearwardly from either side of the forward wall 38, and a rear wall 39 joining the projecting edges of the side walls 40. A lower portion of the rear wall 39 and adjoining segments of the side walls 40 are cut away to form a three-sided lower portion 36 of the bracket collar 34 for receiving the support bar 16. The lower portion of each side wall 40 includes a lateral cross hole 42. A mounting hole 44 extends laterally through the proximal end portion of the support bar 16, and aligns with the holes 42 when the support bar 16 is received by the bracket collar 34.

The first pivot pin 18 passes through the aligned holes 42 and 44 to pivotally secure the support bar 16 to the mounting bracket 26. The tip of the pivot pin 46 may be threaded and secured by a nut 48, as shown. Additionally, low friction washers 50, made of any appropriate material, such as nylon or teflon, may be installed on the pivot pin 46 adjacent the sides of the support bar 16.

In the preferred embodiment of the present invention shown in FIGS. 1 and 2, the stirrup step 20 has a generally triangular configuration, composed of a step portion 52 that is disposed parallel to the plane of the plane of the swim step 12. Side portions 54 of the stirrup step 20 project upwardly and inwardly from each end of the step portion 52 to meet above the center of the step portion where they are welded or otherwise secured to the distal end of the support bar 16.

The mounting bracket 26, support bar 16, and stirrup step 20 may be formed from any high-strength corrosion resistant material, such as aluminum, copper, brass, stainless steel, plated or painted steel, or fiber-reinforced plastics. The stirrup step 20 may be cross-cut from a hollow, substantially triangular extrusion or alternately may be formed from a strip of material, such as aluminum, that is bent to a triangular shape, with the ends of the strip meeting at a point such as the point of attachment to the support bar 16. Alternately, the stirrup step could be formed of three separate members corresponding to the side portions and step portion that are joined together by welding, screws, etc.

A step pad 56 is secured to the upper surface of a step portion 52 to provide a high-friction surface to receive a user's foot. In the preferred embodiment illustrated, the step pad 56 is formed from a sheet of rigid material, such as aluminum, over which a thin laminate of roughly textured plastic has been adhered. The step pad 56 may be secured to the step portion 52 by rivets 58 as shown, or by other conventional means. The long edges of the pad 56 are flared downwardly to prevent cutting or otherwise injuring the user's foot. Alternatively, the step pad 56 may be formed from a pad of rubber that is attached or integrally formed to the step portion 52. Ideally, but not essentially, the step portion 52 and the pad 56 are at an elevation approximately even with or below the bottom of the boat.

As illustrated in FIGS. 1–5, the stirrup step 20 is rotatable from an extended postion to a retracted position. The support bar 16 is preferably of a sufficient length that the distal end portion of the bar and the stirrup step are immersed in the water when the stirrup step is in the extended position, in which the mounting bracket 26, support bar 16, and the stirrup step 20 are longitudinally aligned and project downwardly from the swim step.

When the boat moves through the water at a sufficient speed, drag resistance acting against the reactive surface 24 causes the stirrup step 20 to begin moving toward the retracted position, as illustrated by the dashed lines of FIG. 1, in which the stirrup step and support bar project upwardly at approximately a 45° angle past the rear edge of the swim step 12.

FIGS. 2 through 5 specifically shown the attachment of the extension springs 22 to bias the stirrup step 20 alternately towards its extended and retracted positions. The springs 22 are supported by upper and lower spring mounting pins 58 and 59. The mounting bracket 26 includes aligned threaded holes 60 formed in the upper, forward portion of each side wall 40 of the bracket collar 34. The upper spring mounting pin 58 is threaded to engage with the holes 60 of the bracket collar 34, and is disposed generally parallel to the plane of the flat plate 28 and the length of the first pivot pin 18, as shown in FIG. 2.

The lower spring mounting pin 59 is threaded to engage with a threaded cross hole 62 extending through the support bar 16, at a location between the pivot pin mounting hole 44 and the stirrup step 20, with the hole 62 disposed so that the second pin 59 is parallel to the first pin 58. Each pin 58 and 59 is of sufficient length to project from opposite sides of the mounting bracket collar 34 and the support bar 16. The cross hole 62 is offset slightly from the location of the pivot pin mounting hole 44 toward the transom 14 of the boat, see FIG. 3. The spring mounting pins 58 and 59 include spring retention cross hole 63 formed at each end of the pins, as shown in FIG. 2.

Figure 5:
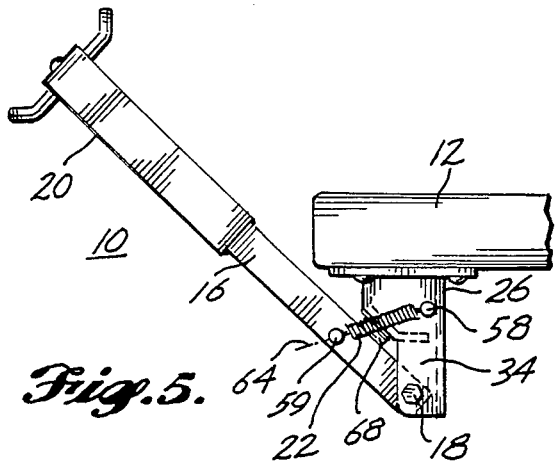
FIG. 5 illustrates a side elevation view of a single-jointed step apparatus in the retracted position.

The springs 22 are preferably conventional coil springs, with the wire used to form the spring terminating in a hook 64 at both ends of the spring. The hooks 64 are inserted into the retention holes 63 in the ends of the mounting pins 58 and 59 to install the springs on the step apparatus 10. As installed (FIG. 4), the springs 22 have a line of action 64, substantially coaxial with the longitudinal axis of the spring, extending between the spring mounting pins 58 and 59, as shown in FIGS. 3 and 5.

The line of action 64 of each spring 22 is substantially perpendicular to the central axis of the first pivot pin 18. The spring mounting pins 58 and 59 are positioned such that when the stirrup step 20 is in its extended position, as shown in FIG. 3, the line of action 64 of each spring is offset from the central axis of the first pivot pin 18, towards the transom 14 of the boat. This offsetting of the line of action 64 of the springs 22 results in the springs 22 biasing the stirrup step 20 toward the transom of the boat, i.e., toward the lowered or extended position.

It should be readily apparent that the spring mounting pins 58 could be located about the step apparatus 10 at other points and still result in the desired offset of the line of action of the springs when the stirrup step is extended. For example, the lower spring mounting pin 59 could be inserted transversely through the stirrup step 20 and offset toward the transom 14 of the boat to result in the same positioning of the line of action of the spring. Similarly, the upper spring mounting pin 58 could be located closer to or further from the pivot pin 18 and still function in the desired manner. It should also be readily apparent that the spring mounting pins 58 may be eliminated by connecting the proximal ends of the springs 22 to tabs (not shown) projecting downwardly from the flat plate 28 of the mounting bracket 26 and the distal ends of the springs 22 to tabs (not shown) projecting outwardly from the side portions 54 of the stirrup step 20. It is also possible to utilize one spring rather than two, although two springs are preferable to balance the biasing forces on either side of the support bar 16.

The stirrup step 20 remains locked in its lowered or extended position due to the biasing of the springs 22 for as long as the step 20 is being used and the boat is stationary or travelling at a very low rate of speed. When the boat moves forwardly at a faster speed, significant drag forces are generated on the reactive surface 24 presented by the immersed portion of the support bar 16 and the stirrup step 20, especially if the step portion 52 and pad 56 are located at or below the bottom of the boat. However, sufficient drag forces will be generated even if the step portion 52 is positioned above the bottom of the boat. The springs 22 are selected so that their biasing force may be overcome by this drag force to allow the stirrup step to begin rotating upwardly and away from the transom of the boat. As this movement begins, with the support bar 16 rotating on pivot pin 18, the line of action 64 of the springs approaches and then passes over the central axis of the pivot pin 18. When the line of action 64 of the springs 22 has passed over the central axis of the pin 18, the springs 22 then act to bias the stirrup step 20 further upwardly until it is fully withdrawn from the water and disposed in its retracted position, as shown in FIG. 5. The springs 22 are selected so that they have sufficient biasing strength to retain the stirrup step 20 in this retracted position until the step is manually returned to the center position for subsequent use. Also note that, if desired, the stirrup step 20 may be manually rotated from the extended position to the retracted position.

The mounting bracket 26 includes abutment stops to delimit the rotation of the stirrup step 20 between the extended and retracted positions. As shown in FIG. 3, when the stirrup step is in its fully extended position the transom facing side of the proximal end of the support bar 16 contacts an extended position abutment stop 64 presented by the lower inside surface of the forward wall 38 of the bracket collar 34. The extended position abutment stop 64 prevents the support bar 16 and stirrup step 20 from rotating past the point of perpendicular alignment to the swim step 12 towards the transom 14.

The bracket collar 34 also includes a retracted position abutment stop 66 that similarly limits the upward rotation of the support bar 16 and stirrup step 20 when the step is in its fully retracted position. The retracted position abutment stop 66 is formed by a plate that is disposed between the sidewalls 40 of the bracket collar 34 at the upper terminus of the three-sided open end portion 36. The retracted position abutment stop is disposed at about a 45° angle from the plane of the flat plate 28 of the mounting bracket 26, so that the swim step 16 when fully retracted projects upwardly past the swim step 12 at approximately a 45° angle, as shown in FIG. 5. A resilient pad 68 is adhered or otherwise joined to the retracted position abutment stop 66 and contacts the support bar 16 when the stirrup step 20 is fully retracted. The resilient pad 68 acts as a shock absorber to prevent the support bar 16 from vibrating, or chattering, against the retracted position abutment stop 66 of the mounting bracket 26 during movement of the boat.

FIGS. 6–9 illustrate an alternate, double jointed, embodiment of a boat step apparatus 70 constructed in accordance with the present invention. The double jointed step apparatus 70 includes a mounting bracket 72, stirrup step 74, first pivot pin 76, support bar 78, upper and lower threaded spring mounting pins 80, two extension springs 82 and a step pad 84 that are substantially the same as the corresponding parts of the first single jointed embodiment of step apparatus 10, with the exception of the following differences. Referring to the exploded view of FIG. 6, the support bar 78 is somewhat shorter than the support bar in the previous preferred embodiment. Rather than being rigidly joined to the distal end of the support bar 78, the stirrup step 74 is pivotally joined to the distal end of the support bar 78 by a second pivot pin 86. The stirrup step 74 includes a pivot bracket collar 88 that is substantially identical to the bracket collar 90 of the mounting bracket 72. Referring additionally to FIG. 7, the pivot bracket collar 88 is disposed opposedly to the mounting bracket collar 90 and receives the distal end of the support bar 78, with the open end portions of the pivot bracket collar 88 and mounting bracket collar 90 both facing rearwardly from the boat transom.

The upper spring mounting pin 80 is threadably engaged with and disposed transversely through the mounting bracket collar 90 as in the first preferred embodiment. The lower spring mounting pin 80 is likewise threadably engaged and disposed transversely through aligned, threaded holes in the pivot bracket collar 88, parallel to the upper spring mounting pin 80, in proximity to the stirrup step 74 and offset towards the transom of the boat, relative to the second pivot pin 86, as shown in FIG. 7. In the extended position, the support bar 78 and stirrup step 74 project downward and generally perpendicularly from the swim step 12, as in the previous preferred embodiment. Lines of action 92 of the springs 82 are disposed perpendicularly to the axes of the first and second pivot pins 76 and 86. The lines of action 92 are offset slightly from the axes of the pins 76 and 86 towards the transom of the boat when the step apparatus 70 is in the extended configuration, as shown in FIG. 7. This disposition of the lines of action 92 of the springs 82 biases the stirrup step 74 toward the extended position when so configured, as in the previous preferred embodiment.

When the step apparatus 70 is in the extended position, the support bar 78 and the stirrup step 74 define a reactive surface 94 facing the transom of the boat against which a water drag resistance force is generated when the boat moves in the forward direction. The drag resistance force acting on the reactive surface 94 overcomes the biasing of the springs 82 to begin movement of the stirrup step 74 toward the retracted position, with the stirrup step pivoting about the second pivot pin 86 and the support bar 78 pivoting about the first pivot pin 76. As the support bar 78 and stirrup step 74 begin this movement, the lines of action 92 of the springs 82 approach and then pass over the central axes of the first and second pivot pins 76 and 86. As soon as the lines of action 92 of the springs pass over the central axes of the pivot pins, the springs 82 act to bias the stirrup step 74 towards the retracted position and complete the movement of the towards that position.

FIG. 9 illustrates the double jointed boat step apparatus 70 in the fully retracted position, with dashed lines showing movement of the stirrup step 74 towards that position. When in the retracted position, the support bar 78 projects rearwardly from the boat transom and generally parallel to the swim step 12. The stirrup step 74 projects generally perpendicularly upwards from the support bar 78 and past the rear edge of the swim step 12. This double jointed configuration results in less rearward protrusion of the step apparatus beyond the swim step than in the previous preferred embodiment.

The double jointed step apparatus assembly also includes abutment stop surfaces to delimit movement of the stirrup step in either direction, similar to the stop services in the previous preferred embodiment. As shown in FIG. 7, when in the extended position, the support bar 16 bears against extended position abutment stops 96 formed by the interiors of the forward facing walls of the mounting bracket collar 90 and pivot bracket collar 88. The stop surfaces 96 prevent further rotation of the stirrup step 74 towards to the transom 14.

Figure 6:
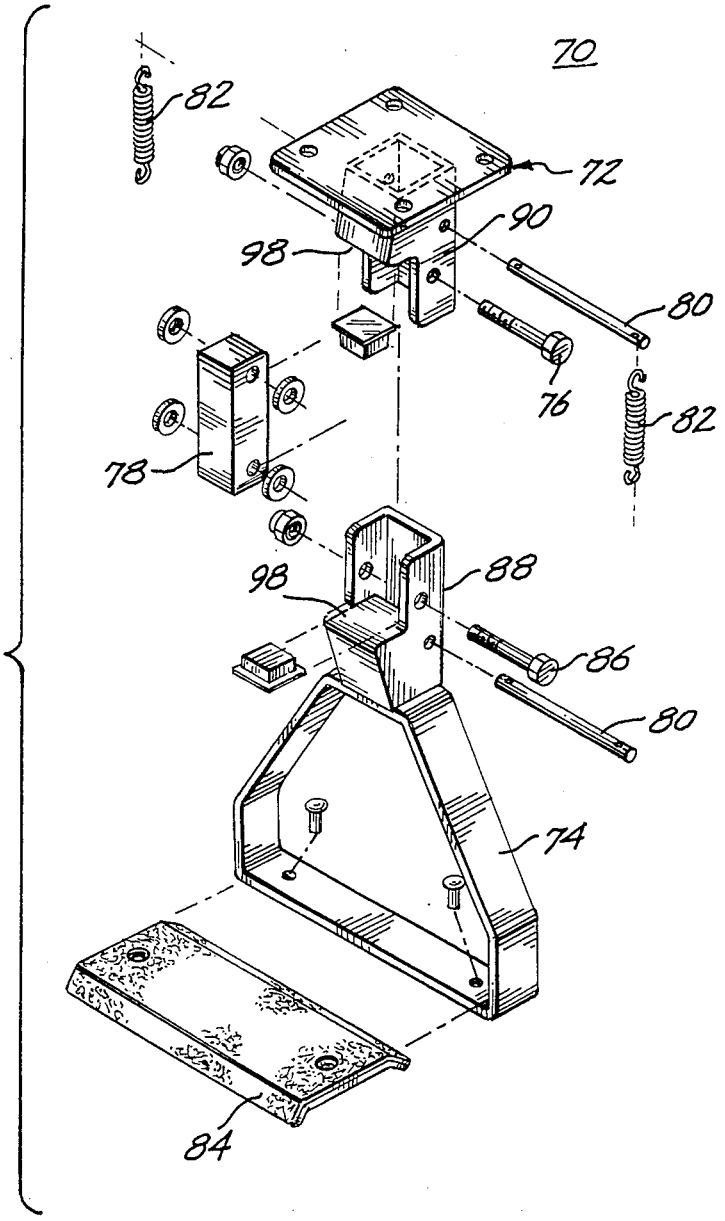
FIG. 6 illustrates an exploded, pictorial view of a double-jointed step apparatus.

Referring to the exploded view of FIG. 6, the pivot bracket collar 88 and mounting bracket collar 90 each also include a retracted position abutment stop 98 formed transversely across the interior of the collars at the terminus of the three sided open portions of the collars. These retracted position abutment stops 98 are disposed similarly to the retracted position stop surface 66 of the previous preferred embodiment, but instead of being angled are positioned so as to be generally parallel to the swim step 12 when the step apparatus 70 is fully extended or fully retracted. A resilient shock absorbing pad 100 is adhered or otherwise joined to each retracted position abutment stops 98. When in the fully retracted position, as shown in FIG. 9, the shock absorbing pads 100 contact the support bar 78 to prevent further forward upward rotation of the stirrup step 72 and to dampen chattering or vibration of the step apparatus during movement of the boat.

The single and double jointed preferred embodiments for step apparatus described above are provided as possible examples of step apparatus constructed in accordance with the above invention. Various changes and alterations may be made to these apparatus within the confines of the present invention. For example, rather than using two parallel coil springs, other spring arrangement such as opposing springs, with one spring acting to bias the step towards the extended position and the other spring acting to bias step towards the retracted position, may be utilized. Further, other types of spring members such as curved ribbon springs or elastic cords may be utilized in place of the coil springs.

As another example, a step apparatus could be configured to mount directly to the transom of a boat or elsewhere on the boat rather than from the underside of a swim step. To effect such a mounting, the mounting bracket would include a mounting plate that is oriented 90° from that in the previous preferred embodiments.

As another example of an alternate configuration, step members configured other than as triangular stirrups may be utilized. For example, referring to the single jointed embodiment, a U-shaped step member suspended from a rod attached transversely to the end of the support bar could be used. Also, instead of using a support bar and an attached stirrup, an elongated U-shaped step member could be employed, with the proximal ends of the side arms of the U-shaped member pivotally attached directly to the mounting bracket and the distal end of the springs attached to the side arms of the step member.

Other types of devices, such as transducers for locating the depth of the water in which a vessel travels, may be suspended by an apparatus configured in accordance with the present invention, rather than a step, by simply securing the device to the distal end of the support bar of the single-jointed embodiment or to the distal end of the mounting bracket of the double jointed embodiment.

Self retracting step apparatuses configured in accordance with the present invention may also be suspended from the undercarriage of other types of vehicles, such as automobiles, trucks, and recreational vehicles. Step apparatuses so configured would be advantageous as they would self retract upon impact with any obstructions projecting upwardly from the roadbed over which the vehicle travels. Similarly, other devices may be mounted on a self retracting mounting apparatus constructed in accordance with the present invention on such land vehicles. Examples of such devices included mirrors or antennas on automobiles and trucks.

The present invention has been described in relation to several preferred embodiments. One of ordinary skill, after reading the foregoing specification, may be able to effect various other changes, alterations and substitutes or equivalents without departing from the broad concepts disclosed. It is therefore intended that the scope of Letters Patent granted hereon be limited only by the definitions contained in the appended claims and the equivalents thereof.

The embodiments of the invention in which an exclusive property or privilege is claimed are defined as follows:

1. A step apparatus, mountable to the exterior of a boat hull to assist a person in climbing into the boat, the step apparatus comprising:

a support member;

a step member, mounted on the support member for receiving a person's foot, the step member and at least a portion of the support member defining a reactive surface;

pivot means for pivotally mounting the support member to the exterior of the boat hull to pivot the apparatus between an extended position and a retracted position; and first biasing means for biasing the step member towards the extended position in which a person may be supported by the step member, the first biasing means capable of being overcome by water drag force acting on the reactive surface during movement of the boat to move the step member towards the retracted position, in which the reactive surface presents a reduced drag profile.

2. The step apparatus of claim 1, further comprising second biasing means for biasing the step member towards the retracted position after it is pivoted from the extended position by water drag force.

3. The step apparatus of claim 2, wherein the pivot means comprises:

mounting bracket means mountable to the exterior of the boat hull; and first pin means for pivotally mounting the step member to the mounting bracket means.

4. The step apparatus of claim 3, wherein the first biasing means and the second biasing means cooperatively comprise spring means, the spring means having a proximal end pivotally secured to the mounting bracket means in proximity to the boat hull, and a distal end pivotally secured to either the support member or the step member, the spring means disposed generally perpendicularly to the central axis of the first pin means and having a line of action offset slightly from the central axis of the first pin means towards the boat hull when the step member is in the extended position, the line of action of the spring means moving relative to the central axis of the first pin means to pass over the central axis of the first pin means as the step member is moved from the extended position to the retracted position.

5. The step apparatus of claim 4, wherein the mounting bracket means includes an extended position abutment stop and a retracted position abutment stop, the extended and retracted position abutment stops acting to de-limit the pivotal movement of the step member, the spring means biasing the support member against the extended position abutment stop when the step member is in the extended position and against the retracted position abutment stop when the step member is in the retracted position.

6. The step apparatus of claim 5, further including shock absorbing means contacting the support member when the step member is in the retracted position to prevent the support member from chattering during movement of the boat.

7. The step apparatus of claim 4, further comprising second pin means for pivotally mounting the step member to the support member, the distal end of the spring means being pivotally secured to the step member, the spring means disposed generally perpendicularly to the central axes of the first and second pin means and having a line of action offset slightly from the central axes of the first and second pin means when the step member is in the extended position, the line of action of the spring means moving to pass over the central axes of the first and second spring means as the step member is moved to the retracted position.

8. The step apparatus of claim 7, further comprising extended position abutment stop means and retracted position abutment stop means, the extended and retracted position abutment stop means acting to de-limit the pivotal motion of the step member, the spring means biasing the support member against the extended position abutment stop means when the step member is in the extended position and against the retracted position abutment stop means when the step member is in the retracted position.

9. The step apparatus of claim 8, further including shock absorbing means secured to the retracted position abutment stop means, the shock absorbing means contacting the support member when the step member is in the retracted position.

10. The step apparatus of claim 7, wherein the boat includes a stern transom and a swim step mounted on the stern transom and projecting generally orthogonally therefrom, and wherein the mounting bracket means is pivotally mounted to the underside of the swim step, when the apparatus is in the extended position the step member and support member projecting downwardly from the underside of the swim step, and when the apparatus is in the retracted position, the support member underlying and generally parallel to the swim step and the step member projecting upwardly from and generally perpendicular to the support member.

11. The step apparatus of claim 2, wherein the boat includes a stern transom and a swim step mounted to the stern transom and projecting generally orthogonally therefrom, and wherein the support member is pivotally mounted by the pivot means to the underside of the swim step, the step member and the support member in the extended position projecting downwardly from the underside of the swim step, and the step member and the support member in the retracted position projecting at angle upwardly from and rearwardly of the swim step.

12. A mounting apparatus for pivotally mounting a device to the exterior of a vehicle, the mounting apparatus comprising:

a support member to which the device is mounted, the support member and the device defining a reactive surface;

pivot means for pivotally mounting the support member to the exterior of the vehicle to pivot the device between an extended position for use and a retracted position for stowage; and first biasing means for biasing the device towards the extended position, the first biasing means capable of being overcome by a resistance force, acting on the reactive surface during movement of the vehicle, to move the device from the extended position to the retracted position.

13. The mounting apparatus of claim 12, further comprising second biasing means for biasing the device towards the retracted position after the device is moved from the extended position by action of the resistance force on the reactive surface.

14. The mounting apparatus of claim 13, wherein the pivot means comprises:

mounting bracket means mountable to the exterior of the vehicle; and first pin means for pivotally mounting the support member to the mounting bracket means.

15. The mounting apparatus of claim 14, wherein the first biasing means and the second biasing means cooperatively comprise spring means, the spring means having a proximal end pivotally secured to the mounting bracket means in proximity to the vehicle exterior; and a distal end pivotally secured to either the support member or the device, the spring means disposed generally perpendicularly to the central axis of the first pin means and having a line of action offset slightly from the central axis of the first pin means when the device is in the extended position, the line of action of the spring means moving to pass over the central axis of the first pin means as the device is moved to the retracted position.

16. The mounting apparatus of claim 15, wherein the vehicle is a boat and wherein the device in the extended position is at least partially immersed in the water, the movement of the boat through the water generating a drag force acting on the reactive surface when the device is in the extended position.

17. The mounting apparatus of claim 16, wherein the device is a step member that in the extended position is capable of supporting the weight of a person climbing into the boat.

18. The mounting apparatus of claim 15, further comprising second pin means for pivotally mounting the device to the support member, the distal end of the spring means being pivotally secured to the device, the spring means disposed generally perpendicularly to the central axes of the first and second pin means and having a line of action offset slightly from the central axes of the first and second pin means when the device is in the extended position, the line of action of the spring means moving to pass over the central axes of the first and second spring means as the device is moved to the retracted position.

19. The mounting apparatus of claim 18, wherein the vehicle is a watercraft and wherein the device in the extended position is at least partially immersed in the water, movement of the watercraft through the water generating a drag force acting on the reactive surface when the device is in the extended position.

20. The mounting apparatus of claim 19, wherein the device is a step member that in the extended position is capable of supporting the weight of a person climbing into the watercraft.

* * * * *